US009572388B2

(12) United States Patent
Carroll

(10) Patent No.: US 9,572,388 B2
(45) Date of Patent: Feb. 21, 2017

(54) HELMET MOUNT

(71) Applicant: NITERIDER TECHNICAL LIGHTING & VIDEO SYSTEMS, INC., San Diego, CA (US)

(72) Inventor: Thomas Edward Carroll, San Diego, CA (US)

(73) Assignee: NITERIDER TECHNICAL LIGHTING & VIDEO SYSTEMS, INC., San Diego, CA (US)

( * ) Notice: Subject to any disclaimer, the term of this patent is extended or adjusted under 35 U.S.C. 154(b) by 209 days.

(21) Appl. No.: 14/608,453

(22) Filed: Jan. 29, 2015

(65) Prior Publication Data

US 2015/0208749 A1 Jul. 30, 2015

Related U.S. Application Data

(60) Provisional application No. 61/933,667, filed on Jan. 30, 2014.

(51) Int. Cl.
*F21V 21/084* (2006.01)
*A42B 3/04* (2006.01)

(52) U.S. Cl.
CPC ..... *A42B 3/0406* (2013.01); *A42B 3/04* (2013.01); *A42B 3/044* (2013.01)

(58) Field of Classification Search
CPC ..... A42B 3/04; A42B 3/0406; A42B 3/0433; A42B 3/044; A42B 3/0446; A42B 3/053
USPC ..... 362/105–106, 396
See application file for complete search history.

(56) References Cited

U.S. PATENT DOCUMENTS

| | | | |
|---|---|---|---|
| 3,830,230 | A | 8/1974 | Chester |
| 7,240,883 | B2 | 7/2007 | Liao |
| 7,549,763 | B2 | 6/2009 | Kim et al. |
| 8,070,308 | B1 | 12/2011 | Lo et al. |
| 8,157,403 | B2 | 4/2012 | Lau |
| 8,292,450 | B2 | 10/2012 | Kim |
| 8,371,707 | B2 | 2/2013 | Uzar |
| 8,403,515 | B2 | 3/2013 | Eichelberger et al. |
| 8,545,069 | B2 | 10/2013 | McCaslin et al. |
| 8,622,567 | B2 | 1/2014 | Uzar |

FOREIGN PATENT DOCUMENTS

DE 102011118982 A1 11/2011

*Primary Examiner* — Jason Moon Han
(74) *Attorney, Agent, or Firm* — Russo & Duckworth, LLP; David G. Duckworth

(57) ABSTRACT

A helmet mount for electronics is provided. The helmet mount includes a clamping bracket for affixing to a helmet chin guard. In addition, the helmet mount includes an adjustable arm, swivel bracket and electronic device. A first end of the arm is rotatably attached to the clamp bracket, and a second end of the arm is rotatably attached to the slider bracket. Meanwhile, the electronic device is attached to the slider bracket that allows it to slide in an arcuate manner. Preferably, the clamp bracket includes a first clamping member and second clamping member which are both movable and rotatable relative to one another.

8 Claims, 10 Drawing Sheets

HELMET MOUNT

RELATED APPLICATIONS

The present application is a continuation of co-pending U.S. Provisional Patent Application Ser. No. 61/933,667 filed on Jan. 30, 2014.

BACKGROUND OF THE INVENTION

The present invention relates to mounts for helmets. More specifically, the invention relates to helmet mounts for mounting electric lights or other electronic devices including cellular telephones, radios, and night vision displays to a helmet.

Snow machines, all-terrain vehicles, motorcycles and other small off-road vehicles are used extensively to travel off-road locations. These vehicles allow for access to back country locations which do not provide for local light sources such a street lights. Most of these recreational vehicles include head lamps that allow the use of the vehicles at night.

Unfortunately, vehicle head lamps are limited. They may illuminate the trail immediately in front of the vehicle, but they do not provide for illumination to areas to the left or right where a driver may be viewing. To overcome this problem, devices have been created to mount a light source to a helmet so that when a driver looks left or right, the light can be turned in that direction.

More recently, persons engaging in mountain biking, off-road motorcycle riding, downhill skiing, snowmobiling, auto racing and other sports have become interested in making and viewing video recordings of their participation in sporting activities. Previously such recordings were made by other parties capturing the participant on video tape. However, such recordings lack the thrill factor experienced by the participant. For this reason, mounts have recently been introduced for mounting cameras to a helmet.

It has also been desirable to provide two-way communications to a person in a helmet engaged in recreational activities. For these reasons, helmets have been developed which integrate cellphone or walkie-talkie communication devices into the helmet casing. Still other constructions provide for mounting a microphone to a recreational helmet. The radio electronics may be mounted to the exterior of the helmet or elsewhere within the vehicle and connected by an electrical cable or a radio frequency (RF) connection such as Bluetooth™.

Clearly, more and more electronics are mounted to helmets. Unfortunately, current mounting systems do not enable the helmet wearer to adjust the electronic device so as to be positioned as desired. Accordingly, there is a significant need for a helmet mount which provides adjustability such that the user can affix the electronics in a desired position, but also allows the wearer to adjust the position quickly and easily.

SUMMARY OF THE INVENTION

The helmet mount of the present invention includes three primary structural components for mounting an electronic device such as a light source, video camera, microphone, etc. The helmet mount's first structure component is a clamping bracket for affixing to the traditional chin protector of a helmet. The clamping bracket includes at least one lower finger and at least one upper finger which are adjustable to clamp down on the helmet's chin protector. A preferred clamping bracket includes two upper fingers and a single lower finger which can be clamped together utilizing a bolt and nut fastener.

The helmet mount further includes an adjustment arm. The adjustment arm preferably has an arcuate profile for conforming to the curved shape of a helmet. At one end, the adjustment arm rotatably attaches to the clamping bracket by a pivotal attachment. To this end, preferably the adjustment arm includes a circular recess for receiving a circular projection formed upon the clamping bracket. Again, preferably the adjustment arm rotatably affixes to the helmet bracket utilizing a bolt and nut fastener. Preferably, the adjustment arm's recess and clamping bracket's circular projection include mating teeth for rotatably locking these components together when the bolt and nut are tightened.

The helmet mount's third structural component is a slider bracket. The slider bracket rotatably affixes to the adjustment arm in similar manner that the adjustment arm affixes to the helmet bracket. Specifically, preferably the slider bracket includes a circular recess for receiving a circular projection formed upon the adjustment arm. Again, the adjustment arm's circular projection and the slider bracket's circular recess may include mating teeth so as to lock the rotational alignment of these components when pressed together by a bolt and nut fastener.

The slider bracket includes an arcuate structure for affixing to an electronic device. More specifically, preferably the slider bracket includes opposed arcuate channels for slidably receiving outwardly projecting arcuate edges provided upon the electronic device. Though the electronic device is slidable in an arcuate path relative to the slider bracket, preferably the electronic device can be locked in place to the slider bracket by providing the slider bracket with teeth for receiving a flexible tab projecting from the electronic device.

The helmet mount enables the wearer of the helmet to adjust the position of an electronic device and its alignment in a wide variety of configurations. The pivot connections allow the adjustment arm to project upward, downward, rearward, or forward, while simultaneously allowing the electronic device to point in each of these directions. Meanwhile, the slider bracket permits the electronic device to rotate inward or outward with respect to the helmet approximately 60°.

Advantageously, the helmet mounting system enables a helmet wearer to adjust the electronic device so as to be positioned as desired.

Furthermore, the helmet mount provides adjustability such that a user can affix electronics in a desired position, but also allows the wearer to adjust the position of the helmet quickly and easily.

DETAILED DESCRIPTION OF THE INVENTION

Figure 1:
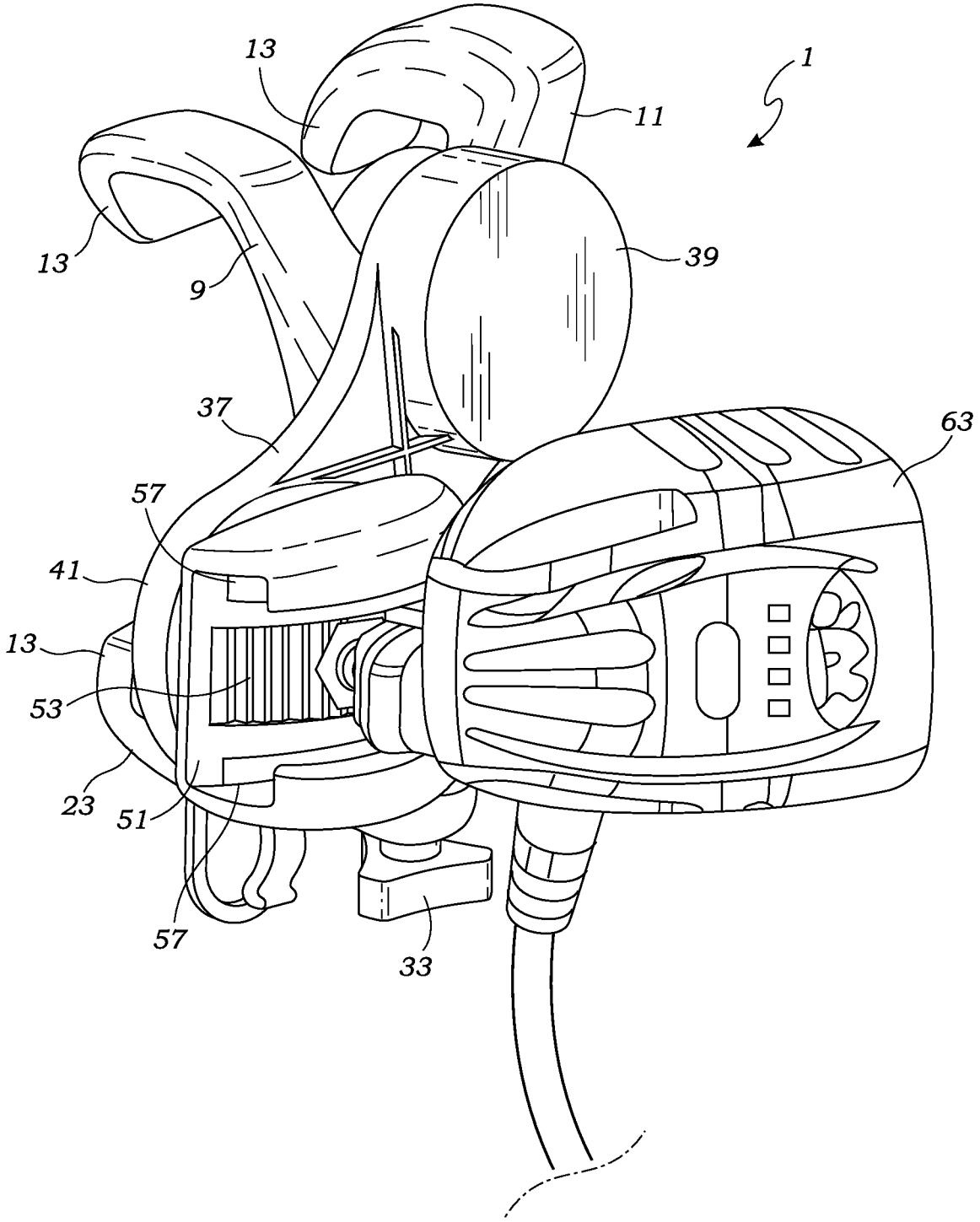
FIG. 1 is a perspective view of the helmet mount of the present invention mounting a light source.

While the present invention is susceptible of embodiments in various forms, as shown in the drawings, hereinafter will be described the presently preferred embodiments of the invention with the understanding that the present disclosure is to be considered as an exemplification of the invention and it is not intended to limit the invention to the specific embodiments illustrated.

With reference to FIGS. 1-10, the present invention is directed to a helmet mount, and more particularly to a helmet mount for mounting electronics 63 to a helmet 3. For purposes herein, the electronics are primarily described and illustrated as being a light source. However, the electronics may be any type as may be mounted to a helmet such as a camera, GPS tracker, microphone, night vision display, etc.

Figure 2:
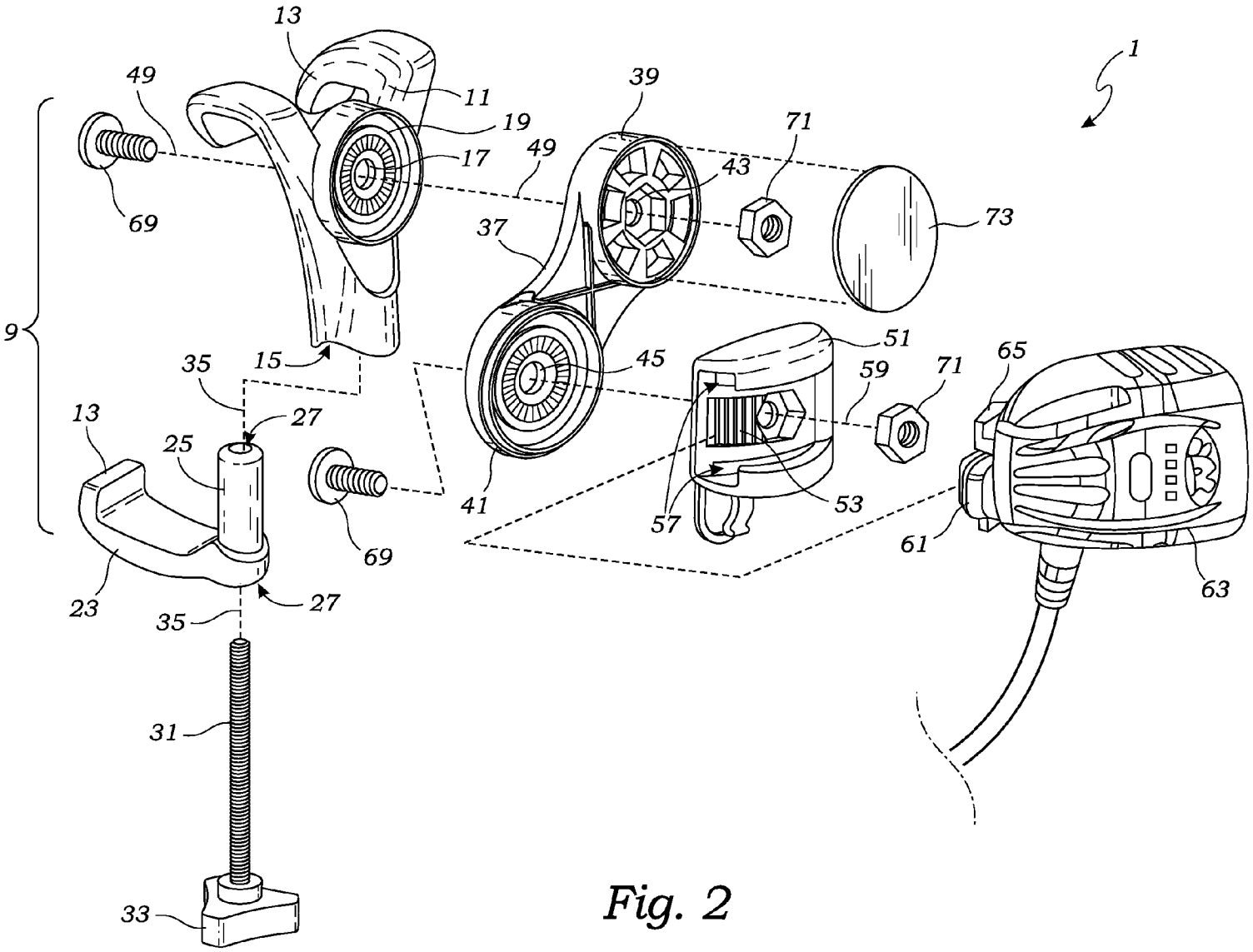
FIG. 2 is a front perspective exploded view of the helmet mount of the present invention illustrated with a light source.
Figure 3:
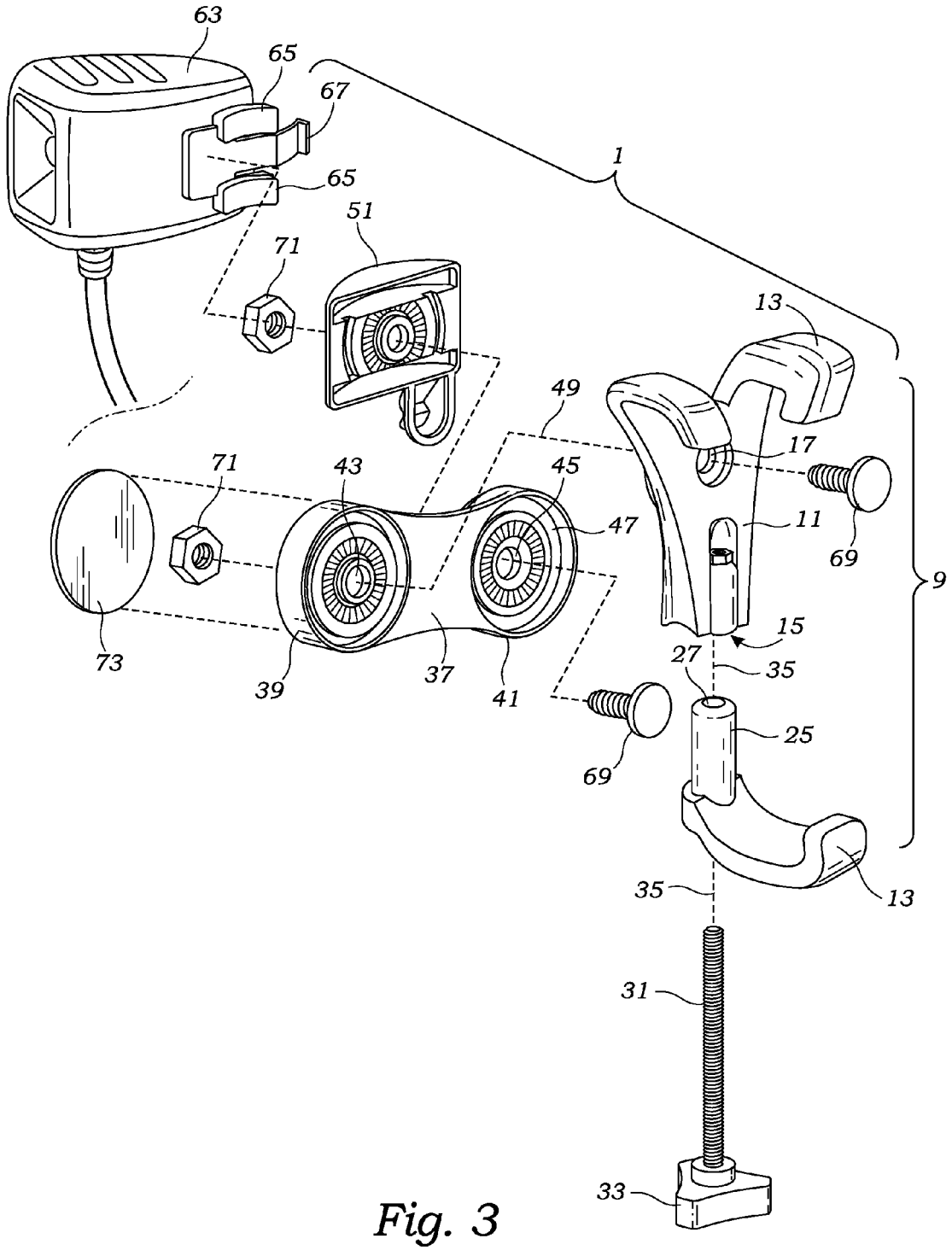
FIG. 3 is a rear perspective exploded view of the helmet mount of the present invention illustrated with a light source.
Figure 4:
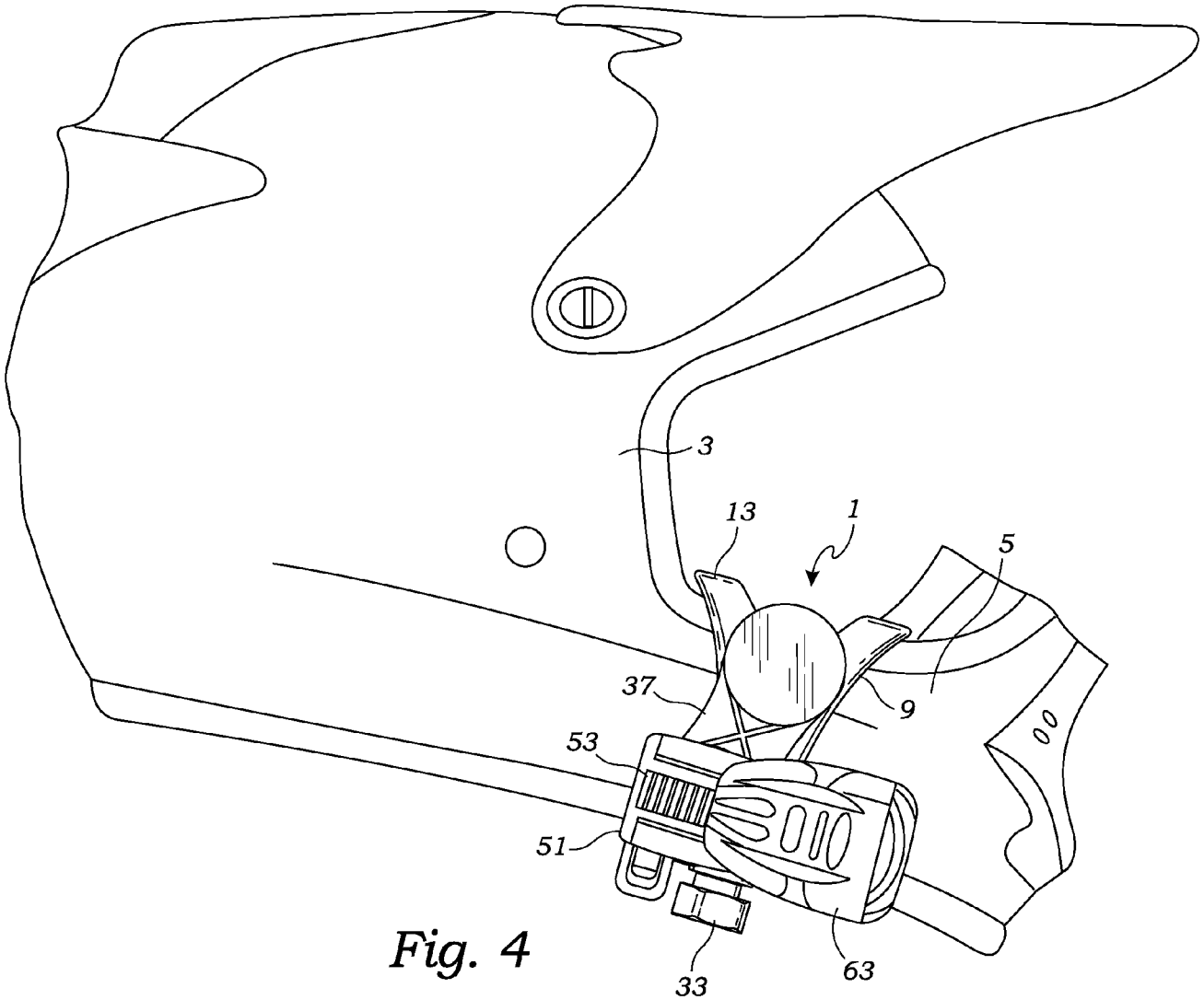
FIG. 4 is a side view of the helmet mount of the present invention illustrated mounting a light source.
Figure 5:
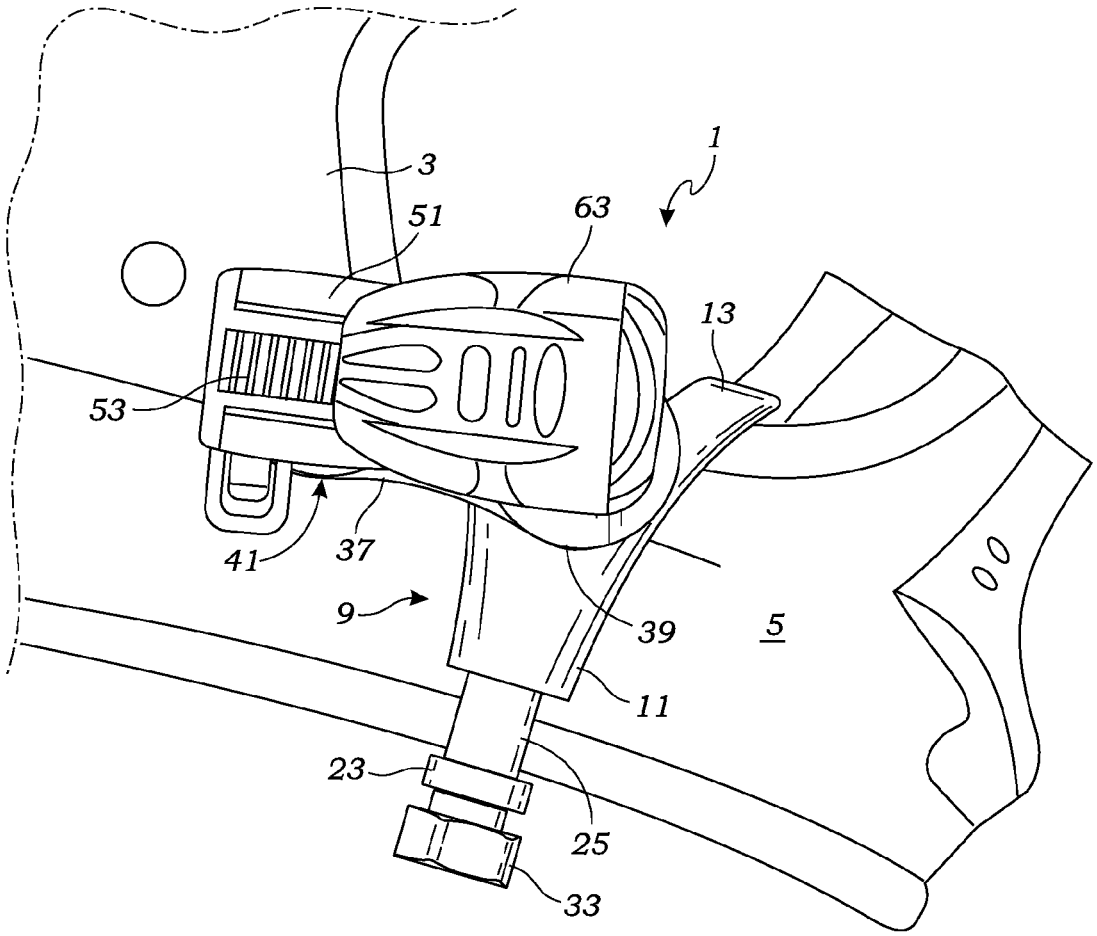
FIG. 5 is a close up side view of the helmet mount of the present invention mounted to a helmet as illustrated in FIG. 4 wherein the light source has been rotated to a second position.
Figure 6:
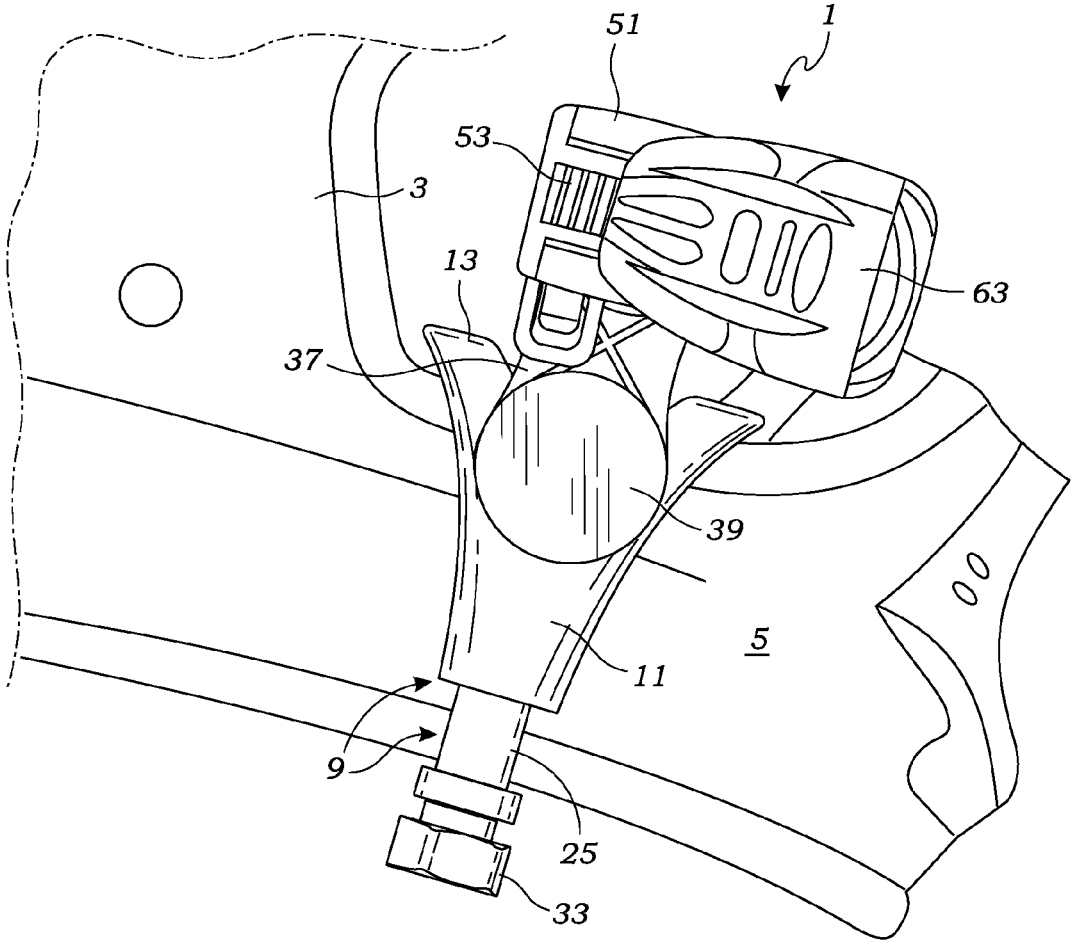
FIG. 6 is a close up side view of the helmet mount of the present invention mounted to a helmet as illustrated in FIG. 4 wherein the light source has been rotated to a third position.
Figure 7:
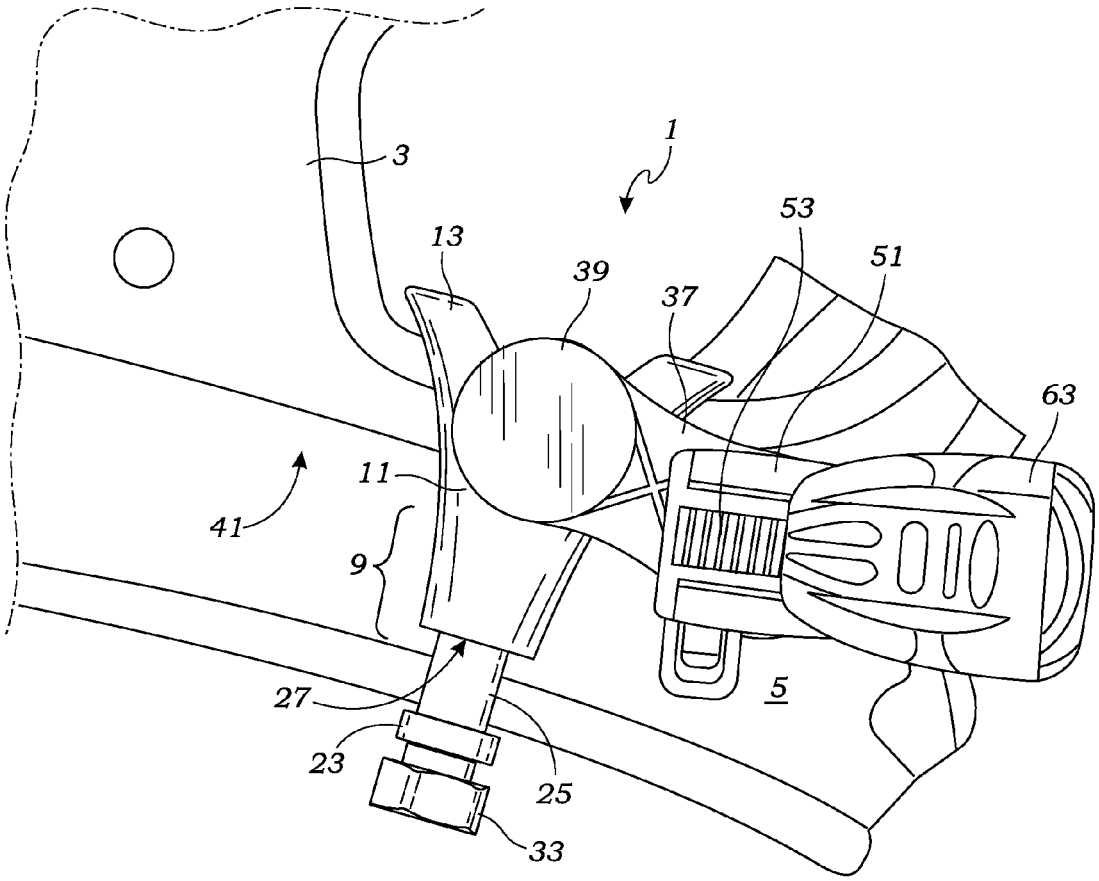
FIG. 7 is a close up side view of the helmet mount of the present invention mounted to a helmet as illustrated in FIG. 4 wherein the light source has been rotated to a fourth position.

As illustrated in FIGS. 4-10, the helmet mount 1 is intended to mount to a helmet's chin protector 5. To affix the helmet mount 1 to the helmet chin protector 5, the helmet 1 includes a clamping bracket 9. As best illustrated in FIGS. 2 and 3, the clamp bracket 9 includes a first clamping member 11 and a second clamping member 23. Each of the clamping members include at least one curved finger 13 for wrapping around an upper or lower edge of the helmet's chin protector 5. In the preferred embodiment illustrated in FIGS. 1-10, the upper clamping member 11 has two fingers 13 while the lower clamping member 23 has only a single finger 13. The respective clamping members 11 and 23 are adjustable so as to move inward or outward relative to each other so as to clamp and affix to a helmet chin protector. In a preferred embodiment, the first clamping member 11 includes a cylindrical bore 15 for slidably and rotatably receiving a cylindrical extension 25 projecting from the second clamping member 23. The second clamping member's cylindrical projection 25 includes a central bore 27 for receiving a male threaded fastener 31 which telescopically extends through the second clamping member's bore 27 to threadably engage a female threaded recess (not shown) formed within the first clamping member's bore 15.

As would be understood by those skilled in the art, tightening the male threaded fastener 31 forces the first and second clamping members together while loosening the male threaded fastener 31 allows the clamping members to retract apart. Advantageously, because the first clamping member's projection 25 is cylindrical, the second clamping member is capable of rotating relative to the first clamping member about a first axis defined by the axis of the male threaded fastener 31. The second clamping member 23 does not need to rotate 360° relative to the first clamping member 11. However, some relative rotation is advantageous because the upper edge and lower edge of a helmet chin protector are not always perfectly parallel. Thus, some relative rotation provides better engagement for the clamp bracket 9 upon the helmet's chin protector 5.

The helmet mount 1 further includes an arm 37 having a first end 39 and a second end 41. Preferably the arm 37 extends in an arcuate profile for at least partially conforming to the curved shape of a helmet. The arcuate profile does not need to be substantial. However, it is preferred that the arm 37 curve at least 1°, and more preferably at least 5°.

The arm's first end 39 rotatably attaches to the clamp bracket 9 so as to rotate about a second axis 49. The arm's first end 39 may be affixed to the clamp bracket 9 by various constructions known to those skilled in the art including rivets, snap-fit arrangements, press-fit arrangements, etc. For example, the clamp bracket 9 or arm's first end may be constructed to include a nubbed post to fit through a simple hole formed in the mating arm or clamp bracket. However, in the preferred embodiment illustrated in the figures, the arm's first end 39 is affixed to the clamp bracket's first clamping member 11 by a bolt 69 and nut 71. The first clamping member 11 includes a hole 17 and the arm's first end 39 includes a hole 43 for receiving the bolt 69. Preferably, the first clamping member further includes a circular projection 19 for entering a circular recess 47 formed with the arm's first end. Loosening the bolt 69 and nut 71 allows one to rotate the arm 37 about the second axis 49 defined by the direction of the bolt 69. By tightening the bolt and nut, one affixes the arm 37 to the clamp bracket 9 so as to prevent their relative rotation. Preferably, the meeting surfaces of the clamp bracket 9 and arm 37 include mating teeth so as to lock these components together.

The helmet mount 1 further includes a slider bracket 51 which rotatably attaches to the arm's second end 41. Again, the slider bracket 51 and arm's second end 41 may be rotatably affixed together by various constructions known to those skilled in the art such as those described above. However, as illustrated in FIGS. 1-10, it is preferred that the slider bracket 51 rotatably affixes to the arm's second end 41 in the same manner that the arm's first end 39 affixes to the clamp bracket 9. To this end, it is preferred that the helmet mount 1 includes an additional bolt 69 and nut 71 which passes through a hole 45 formed in the arm's second end 41 and a hole formed through the slider bracket 51. The bolt 69 provides a third axis 59 around which the slider bracket 51 rotates relative to the arm 37. Also preferable, the slider bracket includes a circular recess 47 for receiving and engaging a circular projection 19 which extends from the arm's second end 41. Furthermore, it is preferred that the mating surfaces of the arm's second end 41 and slider bracket 51 include mating teeth for inhibiting relative rotation of these components when the bolt 69 and nut 71 are tightened.

The helmet mount further includes an electronic device 63 to be mounted to the helmet 3. The electronic device 63 is affixed to the slider mount 51 in a manner that allows the electronic device 63 to slide in an arcuate path and be locked in the desired position. More specifically, the electronic device is not rotatably affixed to the slider mount 51 in the manner that the arm 37 is mounted to the clamp bracket 9 or in the manner that the slider bracket 51 is affixed to the arm 37. Instead, the electronic device is affixed to the slider bracket so as to be able to travel in a curved path so as to point in different desired directions.

The electronic device 63 may be mounted to the slider bracket by various constructions known to those skilled in the art. However, as illustrated in FIGS. 1-10, preferably the slider mount includes opposed arcuate channels 57 for receiving edges 65 which extend outwardly from one another from the back of the electronic device 63. The arcuate channels 57 slidably receive the electronic device's edges 65 so as to allow the electronic device to slide in an arcuate path defined by the direction of the channels 57. Preferably, the slider bracket's channels 57 are constructed to allow the electronic device to slidably move in an arcuate path at least 30°, even more preferably at least 45°, and still even more preferably about 60°. Preferably, the helmet mount is capable of locking the electronic device at a desired position upon the slider mount. To this end, it is preferred that the slider mount include an arcuate tooth surface 53 for engaging a flexible tab 67 extending from the back of the electronic device 63. In operation, the flexible tab 67 is manually biased away from the slider mount surface 53 so as to allow the electronic device to slide in an arcuate path. However, when properly positioned, the tab 67 is allowed to spring back in place so as to engage the slider mount's teeth 53 so as to prevent the electronic device 63 from moving relative to the slider mount 51.

Figure 8:
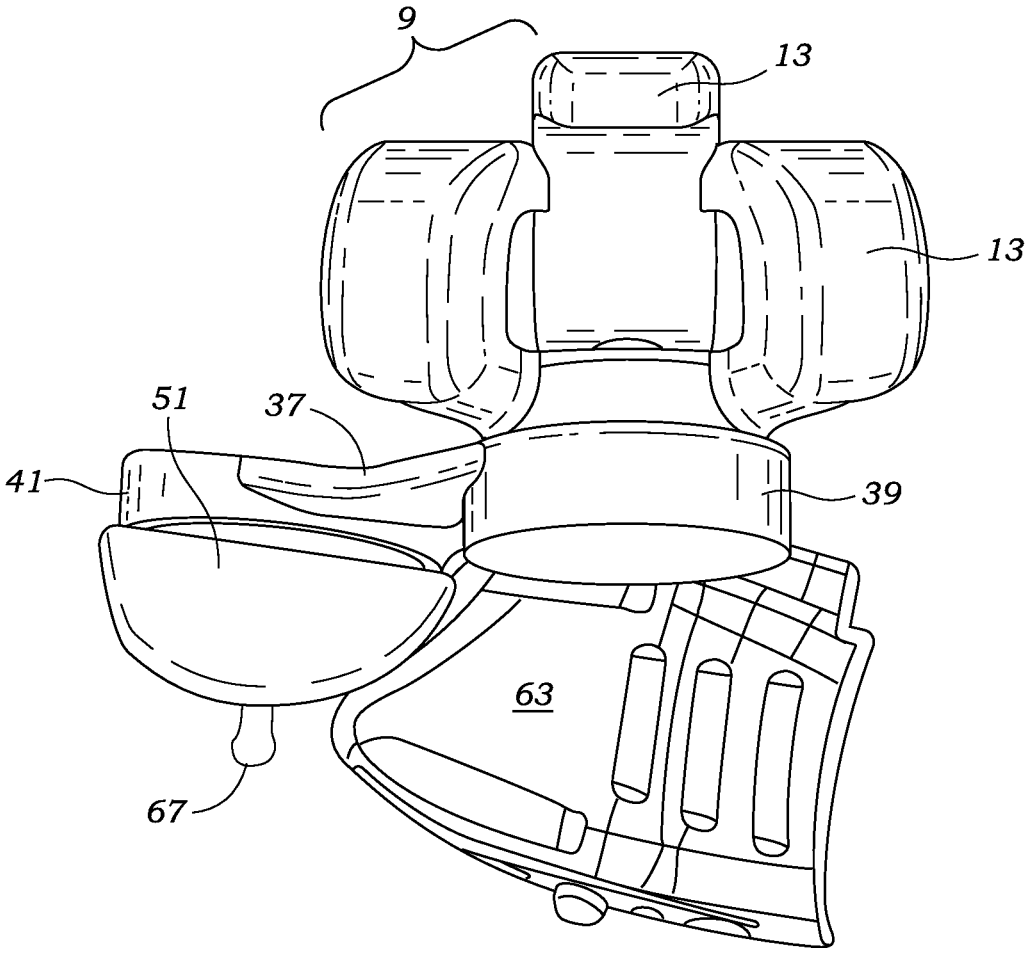
FIG. 8 is a top plan view of the helmet mount of the present invention with a light source.
Figure 9:
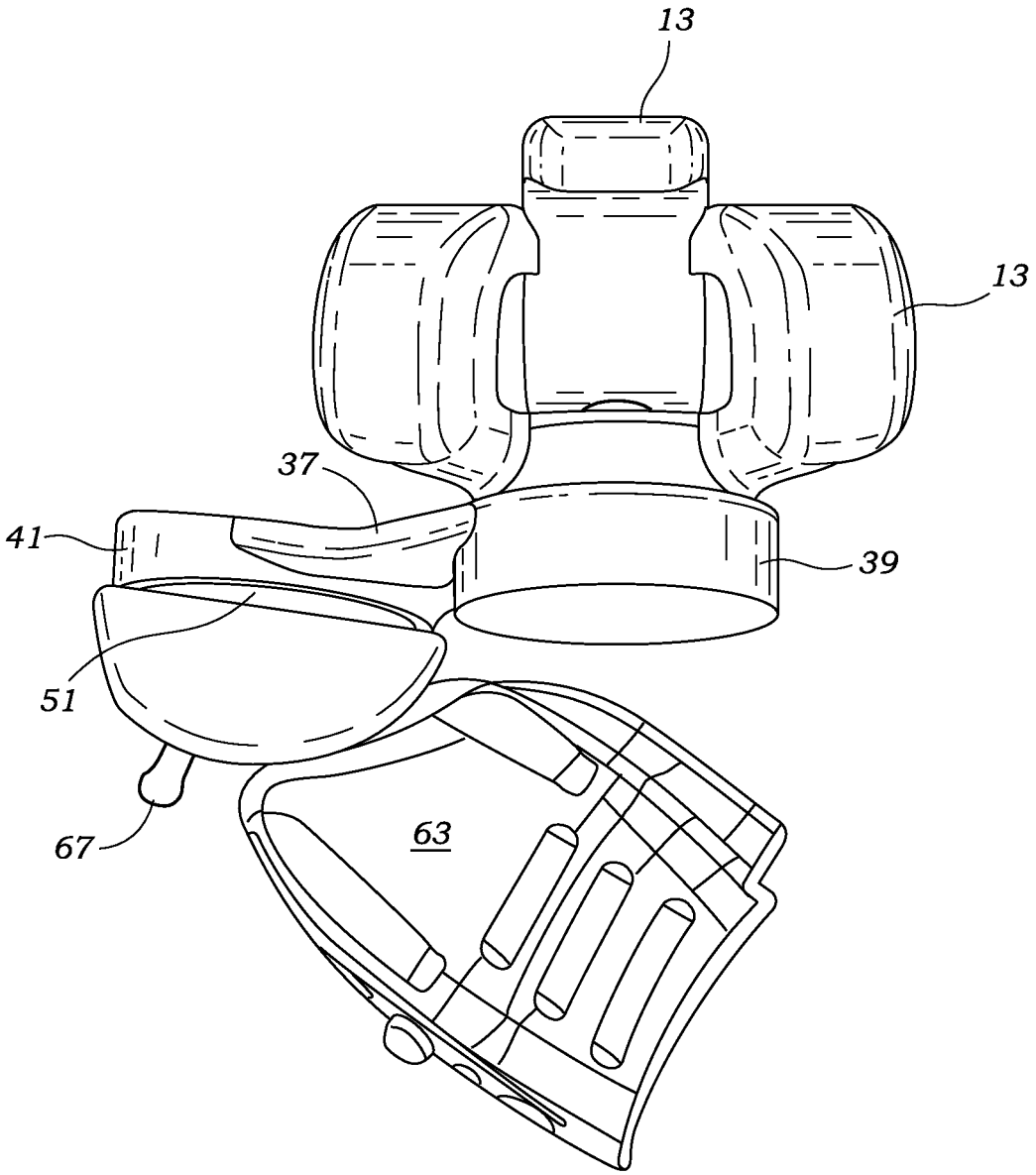
FIG. 9 is a top plan view of the helmet mount of the present invention as illustrated in FIG. 8 wherein the light source has been rotated approximately 30° outward.
Figure 10:
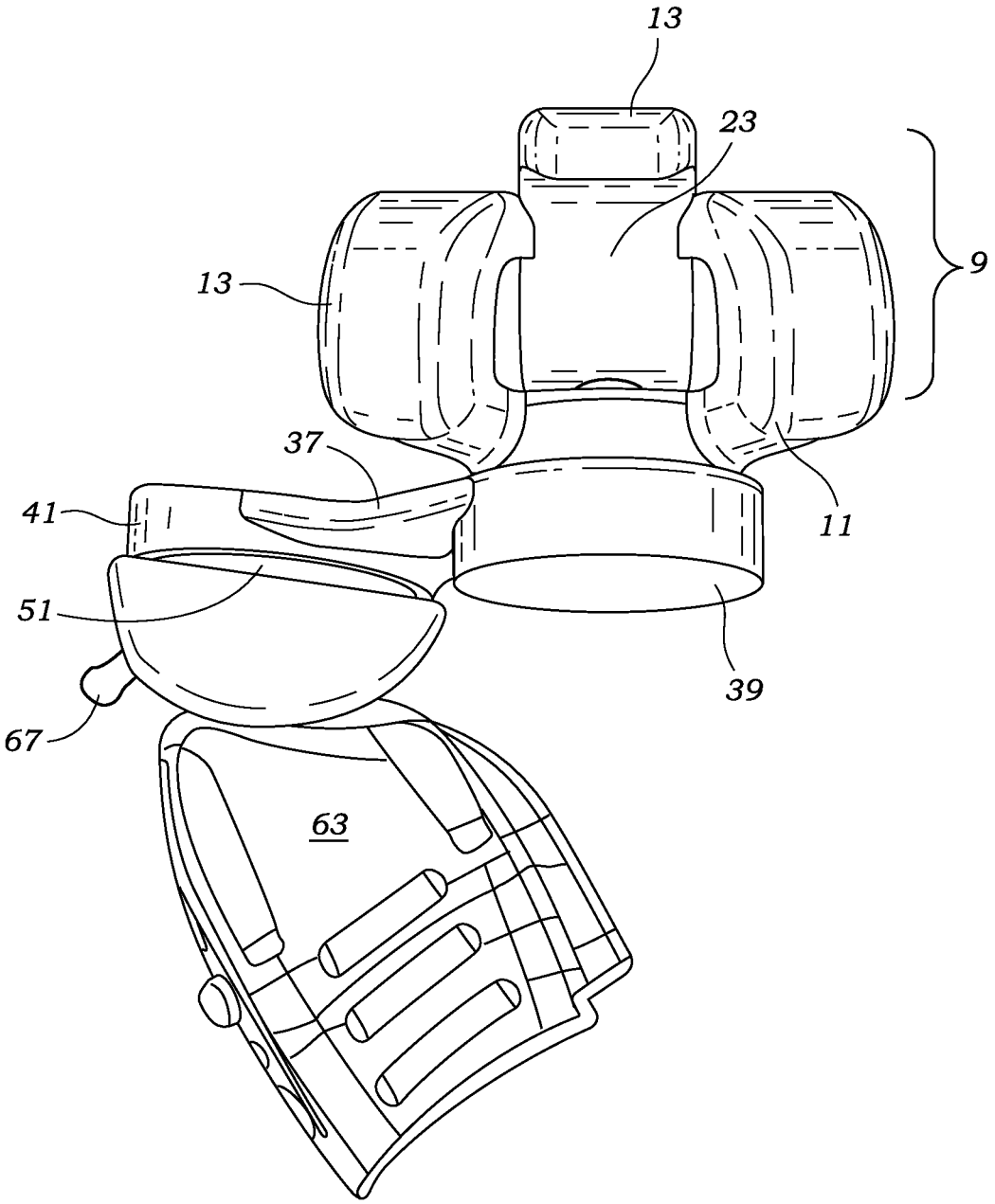
FIG. 10 is a top plan view of the helmet mount of the present invention as illustrated in FIG. 8 wherein the light source has been rotated approximately 60° outward.

As illustrated in FIGS. 4-10, the helmet mount of the present invention allows the wearer to adjust the position and alignment of an electronic device 63. For example, FIGS. 4-7 illustrate how the helmet mount's arm 37 can be rotated relative to the helmet mount's clamp bracket 9 so as to move an electronic device forward, backward, up or down. In each of these positions, the electronic device can be pointed in any direction including up, down, forward, or backward, or anywhere in between. Meanwhile, as illustrated in FIGS. 8-10, the helmet mount's slider bracket 51 allows one to adjust the electronic device 63 to be adjusted to face inward or outward, or anywhere in between.

The various components of the helmet mount can be made by various materials known to those skilled in the art. Preferably, the components are primarily made of high strength plastic to provide light weight and durability. However, it is preferred that the male threaded fastener 31, bolt 69 and nut 71 be made of light weight metals. Other materials including carbon fiber, aluminum, titanium and other alloys would also be acceptable. Furthermore, it is preferred that any conspicuously visible threaded fasteners be covered such as by a decal cover 73.

While several particular forms of the invention have been illustrated and described, it would be apparent that various modifications can be made without departing from the spirit and scope of the invention. Therefore, it is not intended that the invention be limited except by the following claims. Having described my invention in such terms as to enable a person skilled in the art to understand the invention, recreate the invention and practice, and having presently identified the presently preferred embodiments thereof,

I claim:

1. A helmet mount comprising:

a clamp bracket including a first clamping member having at least one arcuate finger and a second clamping member having at least one finger, said clamping bracket further including a threaded fastener for adjustably affixing said first clamping member to said second clamping member wherein the rotation of said threaded fastener causes said first clamping member to move inward or outward relative to said second clamping member so as to allow said first and second clamping member's teeth to affix and clamp to a helmet chin protector, said threaded fastener extending to form a first axis about which said second clamping member is rotatable relative to said first clamping member to provide a first rotatable attachment;

an adjustment arm being arcuate and including first and second ends;

a second rotatable attachment for attaching said adjustment arm's first end to said clamping bracket, said second rotatable attachment allowing said adjustment arm to rotate 360° about a second axis while said clamping bracket remains stationary;

a slider bracket having an arcuate toothed surface;

a third rotatable attachment for attaching said slider bracket to said adjustment arm's second end, said third rotatable attachment allowing said slider bracket to rotate 360° about a third axis while said adjustment arm remains stationary;

an electronic device with a flexible biased tab; and a slidable attachment means for affixing said electronic device adjacent to said slider bracket's arcuate toothed surface but allowing said electronic device to slide in an arcuate motion against said arcuate toothed surface, said flexible biased tab positioned so that said tab is biased into said arcuate toothed surface to lock and prevent arcuate sliding movement of said electronic device against said arcuate toothed surface but said tab capable of being flexed away from said arcuate toothed surface to unlock and allow arcuate sliding movement of said electronic device against said arcuate toothed surface.

2. The helmet mount of claim 1 wherein each of said second and third rotatable attachments comprise a threaded bolt and nut.

3. The helmet mount of claim 1 wherein said slidable attachment means includes opposed arcuate channels formed upon said slider bracket which slidably receive outwardly extending edges formed upon said electronic device.

4. The helmet mount of claim 1 wherein said electronic device is a light source.

5. A helmet, helmet mount, and electronic device combination comprising:

a helmet having an arcuate chin protector;

a clamp bracket affixed to said chin protector, said clamp bracket including a first clamping member having at least one arcuate finger and a second clamping member having at least one finger, said clamping bracket further including a threaded fastener for adjustably affixing said first clamping member to said second clamping member wherein the rotation of said threaded fastener causes said first clamping member to move inward or outward relative to said second clamping member so as to affix and clamp to said helmet chin protector, said threaded fastener extending to form a first axis about which said second clamping member is rotatable relative to said first clamping member to provide a first rotatable attachment;

an adjustment arm being arcuate and including first and second ends;

a second rotatable attachment for attaching said adjustment arm's first end to said clamping bracket, said second rotatable attachment allowing said adjustment arm to rotate 360° about a second axis while said clamping bracket remains stationary;

a slider bracket having an arcuate toothed surface;

a third rotatable attachment for attaching said slider bracket to said adjustment arm's second end, said third rotatable attachment allowing said slider bracket to rotate 360° about a third axis while said adjustment arm remains stationary;

an electronic device with a flexible biased tab; and a slidable attachment means for affixing said electronic device adjacent to said slider bracket's arcuate toothed surface but allowing said electronic device to slide in an arcuate motion against said arcuate toothed surface, said flexible biased tab positioned so that said tab is biased into said arcuate toothed surface to lock and prevent arcuate sliding movement of said electronic device against said arcuate toothed surface but said tab capable of being flexed away from said arcuate toothed surface to unlock and allow arcuate sliding movement of said electronic device against said arcuate toothed surface.

6. The helmet mount of claim 5 wherein each of said second and third rotatable attachments comprise a threaded bolt and nut.

7. The helmet mount of claim 5 wherein said slidable attachment means includes opposed arcuate channels formed upon said slider bracket which slidably receive outwardly extending edges formed upon said electronic device.

8. The helmet mount of claim 4 wherein said electronic device is a light source.

* * * * *